US006202650B1

(12) United States Patent
Kaneki et al.

(10) Patent No.: US 6,202,650 B1
(45) Date of Patent: Mar. 20, 2001

(54) FILTER-TIPPED CIGARETTE AND FILTER FOR A CIGARETTE

(75) Inventors: Kazuyo Kaneki; Keigo Miura; Osamu Komatsubara, all of Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/166,230

(22) Filed: Oct. 5, 1998

(30) Foreign Application Priority Data

Oct. 6, 1997 (JP) ..... 9-272724

(51) Int. Cl.[7] ..... A24B 1/00

(52) U.S. Cl. ..... 131/360; 131/335; 131/336; 131/341; 131/344; 493/47; 55/483

(58) Field of Search ..... 131/360, 335, 131/336, 341, 344; 55/483; 493/47

(56) References Cited

U.S. PATENT DOCUMENTS

| | | | | |
|---|---|---|---|---|
| 4,942,887 | * | 7/1990 | Abdelgawad et al. | 131/336 |
| 5,464,028 | * | 11/1995 | Takeda et al. | 131/336 |
| 5,568,819 | * | 10/1996 | Gentry et al. | 131/342 |

FOREIGN PATENT DOCUMENTS

| | | |
|---|---|---|
| 0295835A1 | 12/1988 | (EP) . |
| 0532329A2 | 3/1993 | (EP) . |
| 0636324A1 | 2/1995 | (EP) . |
| 0797931A1 | 10/1997 | (EP) . |
| 2100573A | 1/1983 | (GB) . |
| 10-004944A | 1/1998 | (JP) . |

* cited by examiner

*Primary Examiner*—Stanley S. Silverman
*Assistant Examiner*—Mark Halpern
(74) *Attorney, Agent, or Firm*—Birch, Stewart, Kolasch & Birch, LLP

(57) ABSTRACT

A filter-tipped cigarette includes a tobacco portion having a tobacco material wrapped by a cigarette paper, and a filter portion which is connected to the tobacco portion. The filter portion has a filter body composed of a plurality of individual filter plug sections, a plurality of individual filter plug wrappers individually wrapping the filter plug sections and an integral filter wrapper integrally wrapping the filter plug sections wrapped by the filter plug wrappers. The tobacco filter portions are integrally connected by a tip paper. The tip paper has a plurality of ventilation holes. The individual filter plug wrapper corresponding to the ventilation holes has an air permeability lower than the integral filter wrapper.

8 Claims, 2 Drawing Sheets

FILTER-TIPPED CIGARETTE AND FILTER FOR A CIGARETTE

BACKGROUND OF THE INVENTION

The present invention relates to a filter-tipped cigarette, and a filter for a cigarette, and more particularly to a filter-tipped cigarette having a filter body composed of a plurality of filter plug sections, and such a filter for a cigarette.

Recently, a tendency of favoring mild tobacco taste for tobacco products such as a cigarette has become increasingly stronger. To obtain mild tobacco taste, techniques of expanding cut tobacco for a cigarette to make the flavor or taste milder, and fitting a filter to the end of tobacco column of a cigarette are used.

In the technique of fitting the filter, in order to make tobacco flavor and taste still milder, it has been a practice that a filter body is composed of a plurality of filter plug sections, such as a so-called dual-filter, and activated carbon or the like is dispersed into the filter plug section arranged at a position away from a mouth end portion. In addition, many ventilation holes are circumferentially made in a so-called tip paper for connecting the filter body to the tobacco column. The taste of the cigarette can be made milder by ambient air sucked through the ventilation holes when smoked. Furthermore, as a filter wrapper for rolling or wrapping a filter body, paper having a higher air permeability is also used.

However, in the technique of making tobacco flavor mild by using the ventilation holes, it is necessary to make a larger number of the ventilation holes (for example, to increase lines of the ventilation holes) in order to make the tobacco flavor still milder. This is not preferable from the viewpoint of the external appearance of the cigarette, and presents a limited ventilation amount. When, for example, 4 lines of ventilation holes are made in the tip paper, the ventilation amount which can be accomplished by means of a filter wrapper having an air permeability of 10000 CORESTA units is at most 70%.

On the other hand, the filter wrapper is more expensive as its air permeability is higher, and thus, use of a filter wrapper having an air permeability higher than necessary is not economical.

BRIEF SUMMARY OF THE INVENTION

Therefore, an object of the present invention is to provide a filter-tipped cigarette having a plurality of filter plug sections as well as such a filter wherein the external appearance of its filter tip is not damaged, and a high ventilation amount can be obtained without use of an expensive filter wrapper having an air permeability higher than necessary.

To accomplish the object, the present invention provides a certain filter portion having a plurality of filter plug sections each wrapped individually by individual filter plug wrappers. These individually wrapped filter plug sections are integrally wrapped by an integral filter wrapper. Such a filter portion is connected to a tobacco portion by a tip paper having ventilation holes perforated therein. Of the individual filter plug wrappers, that individual filter plug wrapper which corresponds to the ventilation holes made in the tip paper is constituted by a low air-permeability paper, and an integral filter wrapper integrally wrapping the filter plug sections wrapped with the individual filter plug wrappers is constituted by a high air-permeability paper.

Accordingly, the present invention provides a filter-tipped cigarette comprising a tobacco portion having a tobacco material wrapped by a cigarette paper, and a filter portion which is connected to one end of the tobacco portion;

the filter portion having a filter body composed of a plurality of individual filter plug sections, a plurality of individual filter plug wrapper wrapping the respective filter plug sections and an integral filter wrapper integrally wrapping the plurality of filter plug sections wrapped by the individual filter plug wrappers, the tobacco portion and the filter portion being integrally connected by means of a tip paper which entirely covers the integral filter wrapper, and covers the proximal end portion of the cigarette paper, the tip paper having a plurality of ventilation holes along the circumference direction of the tip paper and at a position away from a smoking end of the filter portion, the individual filter plug wrapper, that corresponds to the ventilation holes, having an air permeability lower than the integral filter wrapper.

Preferably, the individual filter plug wrapper corresponding to the ventilation holes has an air permeability of about one-third or less (⅓ or less) of that of the integral filter wrapper. Also, preferably, the integral filter wrapper has an air permeability of 30,000 CORESTA units or more.

Further, it is preferred that the air permeability of the individual filter plug wrapper corresponding to the ventilation holes be from 1,800 to 20,000 CORESTA units and/or that a ventilation amount (air inflow amount) through the ventilation holes is 50% or more.

Furthermore, the present invention provides a filter for a cigarette which is to be used in combination with a tip paper having a plurality of ventilation holes made therein, the filter comprising a filter body composed of a plurality of individual filter plug sections, a plurality of individual filter plug wrappers wrapping the respective filter plug sections and an integral filter wrapper integrally wrapping the filter plug sections wrapped by the individual filter plug wrappers, the individual filter plug wrapper, which is to correspond to the ventilation holes, having an air permeability lower than the integral filter wrapper.

In this filter, too, it is preferred that the individual filter plug wrapper which is to correspond to the ventilation holes has an air permeability of about one-third or less of that of the integral filter wrapper. Also, preferably, the integral filter wrapper has an air permeability of 30,000 CORESTA units or more. Further, it is preferred that the air permeability of the individual filter plug wrapper which is to correspond to the ventilation holes be from 1,800 to 20,000 CORESTA units.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described in more detail below, referring to the accompanying drawing FIGURES.

Figure 1:
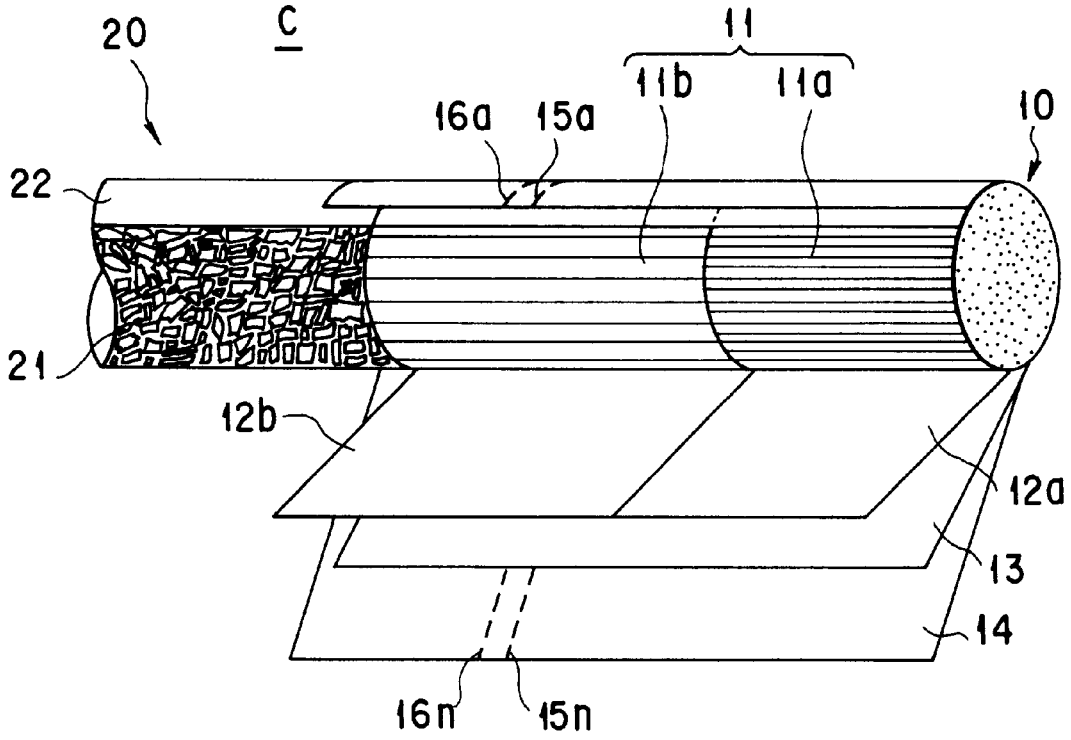
FIG. 1 is a partially cut-off, exploded perspective view of a filter-tipped cigarette of the present invention.

FIG. 1 is a perspective view of a filter-tipped cigarette of the present invention with its tobacco portion partially cut off, in which individual filter plug wrappers, an integral filter wrapper and a tip paper, which will be described in detail below, are developed. The cigarette C has a structure similar to that of a conventional dual-filter-tipped cigarette, except for air permeability properties of the individual filter plug wrappers and the integral filter wrapper in its filter portion.

The filter-tipped cigarette C illustrated in FIG. 1 has a tobacco portion 20 which includes a cigarette paper 22 and a tobacco column 21 consisting of a columnar, preferably cylindrical, tobacco filler materials wrapped by the cigarette paper 22. A filter portion 10 is connected to one tip end of the tobacco portion 20.

The filter portion 10 has a filter body composed of a plurality of filter plug sections connected in series. More specifically, the filter portion 10 shown in FIG. 1 has a so-called dual-filter body 11 composed of a first filter plug section 11*a*, which is a smoking or inhaling portion of the cigarette, and a second filter plug section 11*b* coaxially connected to the first filter plug section 11*a* at the upstream side in the smoked smoke stream. The first filter plug section 11*a* may have a length within the range, for example, from 5 to 25 mm, while the second filter plug section 11*b* may have a length within the range, for example, from 5 to 25 mm. The dual-filter body 11 may usually have a length within the range, for example, from 17 to 30 mm, and its diameter (and hence the diameters of the filter plug sections 11*a* and 11*b*) may be within the range, for example, from 7.3 to 8.3 mm.

The first filter plug section 11*a* may be composed of a so-called plain filter made of only conventional filter materials, such as cellulose acetate fibers, and the second filter plug section 11*b* may be composed of the aforementioned conventional filter materials in which an absorbent such as activated carbon is dispersed. The filter body 11 may usually have an air-permeation resistance of from 50 to 150 $mmH_2O$.

The first filter plug section 11*a* and the second filter plug section 11*b* are individually rolled or wrapped by a first individual filter plug wrapper or wrapping paper 12*a* and a second individual filter plug wrapper or wrapping paper 12*b*, respectively.

The first individual filter plug wrapper 12*a* has the same width as the axial direction length of the first filter plug section 11*a*. The second individual filter plug wrapper 12*b* has the same width as the axial direction length of the second filter plug section 11*b*. In other words, the circumferences faces of the first filter plug section 11*a* and the second filter plug section 11*b* are covered with the individual filter plug wrapper 12*a* and the second individual filter plug wrapper 12*b*, respectively, neither too much nor too. little.

The filter plug sections 11*a* and 11*b* wrapped by the individual filter plug wrapper 12*a* and 12*b*, respectively, are integrally wrapped by a single integral filter wrapper 13. The integral filter wrapper 13 has the same width as the axial direction length of the dual-filter body 11, and the circumferential face of the dual-filter is thus covered, through two individual filter plug wrappers 12*a* and 12*b*, with the integral filter wrapper 13, neither too much nor too little.

The tobacco portion 20 and the filter portion 10 are rolled by a perforated tip paper 14 having a plurality of ventilation holes perforated therein, so as to be connected and integrated with each other. The tip paper 14 entirely covers the circumferential face of the integral filter wrapper 13 and also covers a proximal end portion of the cigarette paper 21 in the tobacco portion 20. The tip paper 14 may be composed of any paper material which is conventionally used as a tip paper.

In this tip paper 14, the plural ventilation holes are made at positions away from the proximal end of the filter 10 (i.e., from the end of the filter opposite to the tobacco portion 20), for example, by a laser perforation means known in the art. The ventilation holes are made such that they are arranged in the form of lines along the circumference of the tip paper 14.

More specifically, FIG. 1 shows a large number of ventilation holes 15*a* to 15*n* constituting the first line, and a large number of ventilation holes 16*a* to 16*n* constituting the second line which is at a distance of, for example, from 0.5 to 1.5 mm away from the first line. (This distance is the distance between the centers of both lines, that is, the distance between the line with which the centers of the first line holes are linked and the line with which the centers of the second line holes are linked.) The diameter of each of the ventilation holes may be, for example, from 0.1 to 0.2 mm. The number of the ventilation holes in each of the lines may be, for example, from 20 to 60. The number of the lines of the ventilation holes made is preferably from 2 to 4. It is sufficient that the air permeability of the tip paper 14 itself is about 1000 to 5000 CORESTA units ($ml/cm^2 \cdot minute$). The filter plug wrapper which corresponds to these ventilation holes (15*a*–15*n*, and 16*a*–16*n*), i.e., the filter plug wrapper which has surface portions exposed by these ventilation holes in the absence of the integral filter wrapper is only the second filter plug wrapper 12*b* in the embodiment shown in FIG. 1. The first filter plug wrapper 12*a* does not have any portions exposed by the ventilation holes (15*a*–15*n*, and 16*a*–16*n*) in the absence of the integral filter wrapper, and thus, does not correspond to the ventilation holes.

In the prior art, the double layers of paper wrapping the filter (that is, the respective individual filter plug wrappers for wrapping the respective filter plug sections, and the integral filter wrapper) are composed of two papers having the same air permeability. However, the inventors have examined the total air permeability of both wrappers placed one upon the other with the air permeability of the wrappers changed. As a result, in both cases of arranging the integral filter wrapper having a high air permeability at the upstream side of air flowing-in from the ventilation holes (at the outside) and the filter plug wrapper having a low air permeability at the downstream side thereof (at the inside), and contrarily of arranging the integral filter wrapper having a low air permeability at the outside and the filter plug wrapper having a high air permeability at the inside, the total air permeability of the both wrappers placed one upon the other was decided by the wrapper having a low air permeability, as expected. Therefore, it was expected in both cases that the ventilation amount (the ratio of air flowing-in from the ventilation holes and passing through the filter plug wrapper and the integral filter wrapper into cigarette smoke) should be governed by the wrapper having a low air permeability.

However, the inventors have rolled a filter by two wrappers having different air permeabilities, rolled this filter together with a tobacco portion by a perforated tip paper to provide a filter-tipped cigarette, and measured its ventilation amount. As a result, the present inventors have found that the ventilation amount in the case of arranging the wrapper having a lower air permeability at the inside is different from that in the case of arranging the same wrapper at the outside. More specifically, the present inventors have found that the cigarette wherein the wrapper having a high air permeability is arranged at the outside has a significantly higher ventilation amount than that wherein the same wrapper is arranged at the inside. This finding is entirely contrary to the inventors' expectation. The present invention is based on this finding.

On the basis of the aforementioned finding, the present inventors have made further investigation, and consequently have found that it is preferred that the outer integral filter wrapper (corresponding to the wrapper 13 in FIG. 1) for integrally wrapping the filter plug sections have a high air permeability of 30,000 CORESTA units or more, and that if, among the individual filter plug wrappers (corresponding to the filter plug wrappers 12*a* and 12*b* in FIG. 1) for individually wrapping the respective filter plug sections (corresponding to the filter plug sections 11*a* and 11*b* in FIG. 1), only the filter plug wrapper (corresponding to the filter plug wrapper 12*b* in FIG. 1) which corresponds to the ventilation holes made in the perforated tip paper (that is, which has surface portions exposed by the ventilation holes, in absence of the integral filter wrapper, as described above) has an air permeability lower than that of the integral filter wrapper (preferably an air permeability of one third or less of the air permeability of the integral filter wrapper), desired improvement in ventilation can be accomplished sufficiently.

In this case, the filter plug wrapper which does not correspond to the ventilation holes (i.e., the filter plug wrapper corresponding to the first filter plug wrapper 12*a* in FIG. 1), among the filter plug wrappers 12*a* and 12*b* in which the filter plug sections 11*a* and 11*b* are rolled, does not have any influence on the aforementioned ventilation ratio. Thus, the filter plug wrapper 12*a* which does not correspond to the ventilation holes may be a paper having any air permeability. Of course, when the ventilation holes are made so that the first filter plug wrapper 12*a* corresponds to the ventilation holes, the aforementioned relationship with the integral filter wrapper 13 (i.e., the air permeability lower than the integral filter wrapper, preferably the air permeability of one third or less of the air permeability of the integral filter wrapper 13) is applied to the first filter plug wrapper 12*a*, too.

In case wherein the integral filter wrapper 13 has a higher air permeability than the second filter plug wrapper 12*b* in such a manner as above, the filter having the aforementioned structure can exhibit a ventilation amount of 50% or more when the ventilation holes made in the tip paper are provided in two lines, as will be described in Examples below.

Thus, the integral filter wrapper 13 preferably has a high air permeability of 30,000 CORESTA units or more, but the second filter plug wrapper 12*b* corresponding to the ventilation holes may usually have an air permeability of from 1,800 to 20,000 CORESTA units.

It has been found that if the air permeability of the second filter plug wrapper 12*b*, i.e., the filter plug wrapper corresponding to the ventilation holes, is 7,000 to 20,000 CORESTA units, the ventilation amount becomes substantially constant, establishing a stable ventilation amounts even if the air permeability of the filter plug wrapper 12*b* varies.

Returning to FIG. 1, the tobacco portion 20 in the filter-tipped cigarette of the present invention has a cigarette column 21 made of a tobacco material such as a cut tobacco and an expanded cut tobacco. The tobacco column 21 is wrapped by a conventional cigarette paper 22. As described above, the tobacco portion 20 is connected to the filter portion 10 by means of the perforated tip paper 14, so that one end of the portion 20 is linked to the filter portion 10. The perforated tip paper 14 extends from the integral filter wrapper 13 to the cigarette wrapper 22 so that the proximal end portion of the cigarette wrapper 22 is covered with the tip paper 14.

As can be understood from the foregoing description of the filter-tipped cigarette, the filter for a cigarette according to the present invention is used in combination with the tip paper having the ventilation holes made therein. Referring to FIG. 1, the embodiment of the filter for a cigarette according to the present invention will be briefly described for convenience of understanding. The filter according to the present invention has the filter body 11 composed of a plurality of, for example, two, filter plug sections 11*a* and 11*b*. The filter plug sections 11*a* and 11*b* are directly and individually rolled by the respective filter plug wrappers 12*a* and 12*b*. The filter plug sections 11*a* and 11*b* rolled by the respective filter plug wrappers 12*a* and 12*b* are integrally wrapped by the integral filter wrapper 13 having an air permeability of, preferably, 30000 CORESTA units or more. When the filter is used in combination with the perforated tip paper 14 (that is, the filter is rolled together with the tobacco portion 20 by the perforated tip paper 14), the filter plug wrapper 12*b* corresponding to the ventilation holes (15*a* to 15*n* and 16*a* to 16*n*) has an air permeability satisfying the aforementioned relationship with the integral filter wrapper 13 (lower than the permeability of the integral filter wrapper, preferably one third of the air permeability of the integral filter wrapper 13).

When the first filter plug section 11*a* individually rolled by the first filter plug wrapper 12*a* is represented by A and the second filter plug section 11*b* individually rolled by the second filter plug wrapper 12*b* is represented by B in such a filter, it is a general practice that a plurality of units of a connected body BAAB are put together and integrated by means of the integral filter wrapper to provide a product (for example, BAABBAAB, BAABBAABBAAB). In manufacturing the filter-tipped cigarette, this integrated product is firstly cut between the two adjacent filter plug sections B and B to obtain the plural connected bodies. Then, the tobacco portions 20 are fitted to both B ends of each of the connected bodies, and are connected to both the ends by means of a perforated tip paper. This perforated tip paper has a form in which two pieces of the tip paper 14 shown in FIG. 1 are symmetrically connected to each other at their proximal ends. Subsequently, the tip paper and the integral filter wrapper of the filter connected body whose both ends are connected to the filter portions 20 are cut so that the adjacent filter plug sections A and A are cut. Thus, two filter-tipped cigarettes are obtained. This connected body, as well as the filter for a cigarette which is in such a form that the connected bodies are put together, is also within the scope of the present invention.

The present invention will be described by way of Examples which follow.

EXAMPLES 1 TO 5, AND COMPARATIVE EXAMPLES 1 TO 5

Firstly, two wrappers shown in Table 1 below (i.e., a wrapper corresponding to the filter plug wrapper 12*b* in FIG.

1, which will be hereinafter referred to as the filter plug wrapper, and a wrapper corresponding to the integral filter wrapper 13, which will be hereinafter referred to as the integral filter wrapper) were placed one upon the other so that the integral filter wrapper would be arranged on the filter plug wrapper. With regard to the double layer-wrapper, the permeation degree of air passing through the wrappers from the filter plug wrapper side was measured (total air permeability). For this measurement, an air permeability meter (Product name: PPM100) available from Filtrona Co., Ltd. was used.

Results obtained are shown in Table 1 (the column of Total Air Permeability). It is understood from these results that the total air permeability of the two wrappers place on upon the other is decided by the wrapper having a lower air permeability.

Next, a perforated tip paper, a filter plug wrapper and an integral filter wrapper shown in Table 1 were used to obtain dual-filters having the structure shown in FIG. 1 by a conventional method. In this case, the material of the first filter plug wrapper 12*a* shown in FIG. 1 was the same as the material of second filter plug wrapper 12*b*.

Using the dual-filters, filter-tipped cigarettes were prepared which had a diameter of 7.9 mm, and a total length of 84 mm. The cut tobacco constituting the cigarette columns 21 was a blend of cut tobacco for conventional cigarette products. Their filling density was 220 mg/cm$^3$. The air permeability of the cigarette paper 22 was 35 CORESTA units. The length of the plain filter plug section (the first filter plug section 11*a* in FIG. 1) at the proximal portion of the dual-filter was 10 mm, and its air permeation resistance was 46 mm$H_2O$ when sucked at an air flow rate of 17.5 ml/second. The length of the filter plug section (the second filter plug section 11*b* in FIG. 1) connected to the plain filter plug section was 15 mm, and its air permeation resistance was 69 mm$H_2O$ when sucked at an air flow rate of 17.5 ml/second.

The tip paper 14 was a paper in which 2 lines of the ventilation holes were made (designated by L(2)), or a paper in which 4 lines of the ventilation holes were made (designated by L(4)). The number of the effective ventilation holes were 46 in each line. In case of the L(2), the centers of the ventilation hole lines were positioned at 13.5 mm and 15 mm from the filter proximal end (the smoking end). In case of the L(4), the centers of the ventilation hole lines were positioned at 12 mm, 13.3 mm. 14.6 mm and 15.9 mm from the filter proximal end. The air permeability of the tip paper 14 itself is shown in Table 1.

The filter-tipped cigarettes prepared were smoked at their filter ends by using a measuring meter (an automatic ventilation meter AVM available from Filtrona Co., Ltd.) to measure inflow ratios of ambient air from the ventilation holes, that is, filter ventilation amount (Vf). Results thus obtained are also shown in Table 1 (the column of Vf Value (%)).

Figure 2:
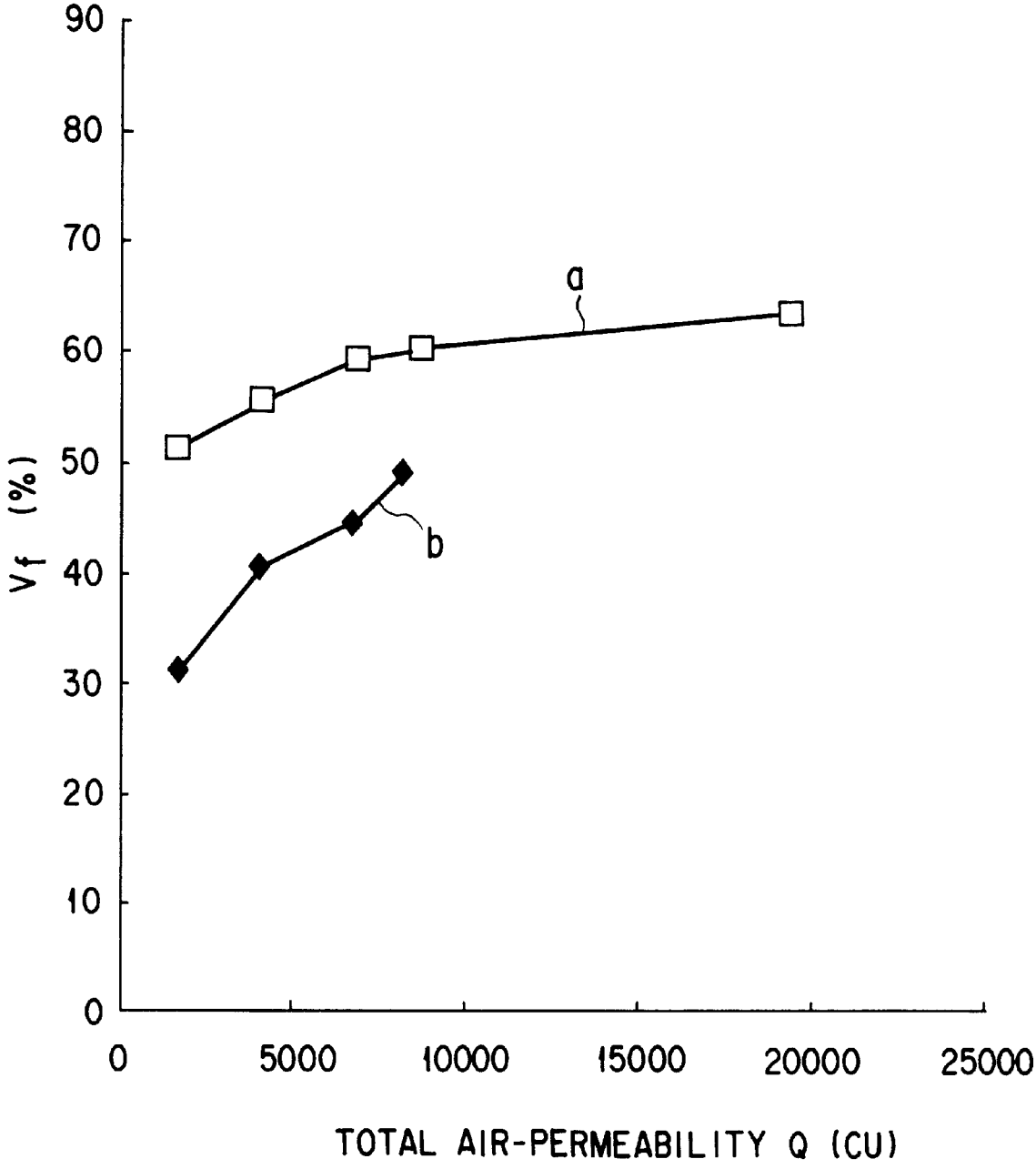
FIG. 2 is a graph showing results of Examples 1 to 4 of the present invention, together with results of Comparative Examples 1 to 4.

The results obtained on the filter-tipped cigarettes of Examples 1 to 4 and Comparative Examples 1 to 4 are shown as a graph in FIG. 2. In FIG. 2, a line a is concerned with Examples 1 to 4, and their Vf values are represented as a function of the total air permeability (shown by the abscissa in FIG. 2) of the whole of the filter plug wrapper and the integral filter wrapper placed one upon the other. A line b is concerned with Comparative Examples 1 to 4, and their Vf values are represented as a function of the total ventilation value (shown by the abscissa in FIG. 2) of the whole of the filter plug wrapper and the integral filter wrapper placed one upon the other.

The line a concerned with Examples of the present invention also represents a Vf value as a measured value in case of the air permeability of the filter plug wrapper being 34600.

TABLE 1

| | Air Permeability of Tip Paper (CU*) | Air Permeability of Filter plug wrapper (CU*) | Air Permeability of Filter Wrapper (CU*) | Total Air Permeability (CU*) | Vf Value (%) |
|---|---|---|---|---|---|
| Examples | | | | | |
| 1 | L(2) | 1840 | 34600 | 1830 | 51.4 |
| 2 | 1200 | 4200 | 34600 | 4210 | 55.6 |
| 3 | | 7230 | 34600 | 7020 | 59.4 |
| 4 | | 9900 | 34600 | 8780 | 60.3 |
| 5 | L(4) 2400 | 9900 | 34600 | 8780 | 75.6 |
| Comparative Examples | | | | | |
| 1 | L(2) | 34600 | 1870 | 1800 | 31.4 |
| 2 | 1200 | 34600 | 4200 | 4110 | 40.5 |
| 3 | | 34600 | 7230 | 6800 | 44.6 |
| 4 | | 34600 | 9900 | 8250 | 49.1 |
| 5 | L(4) 2400 | 34600 | 9900 | 8250 | 65.8 |

Note): CU = CORESTA unit (the same as in FIG. 2)

As can be understood from the results shown in Table 1 and FIG. 2, when the double-wrappers construction of the present invention is combined with the perforated tip paper, the ventilation amount increases significantly. Therefore, the taste of the cigarettes can be made still milder. According to the filter of the present invention, a desired improvement in ventilation can be accomplished without the number of the lines of the ventilation holes being increased. As is evident from FIG. 2, when the air permeability of the filter plug wrapper is 7,000 CORESTA units or more, the ventilation amount is kept substantially constant, establishing a stable ventilation amount regardless of the variation in the air permeabilities of the filter plug wrapper 12*b*.

As has been described above, there are provided by the present invention a filter-tipped cigarette wherein the appearance of its tip is not damaged, and a high ventilation amount can be obtained without using any expensive filter plug wrapper which has a high air permeability, as well as such a filter for a cigarette to be used in combination with a perforated tip paper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter-tipped cigarette comprising a tobacco portion having a tobacco material wrapped by a cigarette paper, and a filter portion which is connected to one end of the tobacco portion;

the filter portion having a filter body composed of a plurality of individual filter plug sections, a plurality of individual filter plug wrappers wrapping the respective filter plug sections and an integral filter wrapper integrally wrapping the plurality of filter plug sections wrapped by the individual filter plug wrappers, the tobacco portion and the filter portion being integrally connected by means of a tip paper which entirely covers the integral filter wrapper, and covers a proximal end portion of the cigarette paper, the tip paper having a plurality of ventilation holes along a circumferential direction of the tip paper and at a position away from a smoking end of the filter portion, at least one of the individual filter plug wrappers is axially aligned with the ventilation holes on the tip paper and has an air permeability of about one-third or less of an air permeability of the integral filter wrapper.

2. The filter-tipped cigarette according to claim 1, wherein said at least one individual filter plug wrapper axially aligned with the ventilation holes has an air permeability of 1,800 to 20,000 CORESTA units.

3. The filter-tipped cigarette according to claim 1, wherein said integral filter wrapper has an air permeability of 30,000 CORESTA units or more.

4. The filter-tipped cigarette according to claim 1, which has an air inflow amount through the ventilation holes is 50% or more.

5. A filter for a cigarette which is to be used in combination with a tip paper having a plurality of ventilation holes made therein, said filter comprising a filter body composed of a plurality of individual filter plug sections, a plurality of individual filter plug wrappers individually wrapping the respective filter plug sections, and an integral filter wrapper integrally wrapping the filter plug sections wrapped by the individual filter plug wrappers, and at least one of the individual filter plus wrappers is axially aligned with the ventilation holes on the tip paper and has an air permeability less than an air permeability of the integral filter wrapper.

6. The filter according to claim 5, wherein said at least one individual filter plug wrapper axially aligned with the ventilation holes has an air permeability of about one-third or less of the air permeability of the integral filter wrapper.

7. The filter according to claim 6, wherein said at least one individual filter plug wrapper axially aligned with the ventilation holes has an air permeability of 1,800 to 20,000 CORESTA units.

8. The filter according to claim 5, wherein said integral filter wrapper has an air permeability of 30,000 CORESTA units or more.

* * * * *